US005406648A

United States Patent [19]

Butzer et al.

[11] Patent Number: 5,406,648

[45] Date of Patent: Apr. 18, 1995

[54] THERMAL PROTECTIVE OVERJACKET

[75] Inventors: Melissa J. Butzer, Newark, Del.; Christopher E. Coombs, Boonton, N.J.

[73] Assignee: Cairns & Brother Inc., Clifton, N.J.

[21] Appl. No.: 105,721

[22] Filed: Aug. 12, 1993

[51] Int. Cl.[6] ..... A41D 13/00

[52] U.S. Cl. ..... 2/81; 2/86; 2/97; 2/100; 2/129

[58] Field of Search ..... 2/2, 60, 70, 69, 81, 2/82, 85, 86, 87, 93, 97, 98, 99, 100, 129, 131, 135, 141.1

[56] References Cited

U.S. PATENT DOCUMENTS 4,507,806 4/1985 Coombs ..... 2/81

4,604,759 8/1986 Bowman et al. ..... 2/81

*Primary Examiner*—Clifford D. Crowder

*Assistant Examiner*—Diana Biefeld

*Attorney, Agent, or Firm*—R. Gale Rhodes, Jr.

[57] ABSTRACT

A protective thermal overjacket for being worn over an outer protective shell and/or inner thermal liner of a person such as a firefighter, and for providing additional flame and thermal protection to the upper torso of the firefighter particularly the upper chest, upper back, and upper arms of the firefighter's body. Fasteners may be provided for interconnecting the collars of the protective thermal overjacket, the inner thermal liner and the outer protective garment; alternatively, the collar of the protective thermal overjacket may be provided with a fastener for fastening the collar of the overjacket around the collar of the outer protective garment.

1 Claim, 5 Drawing Sheets

THERMAL PROTECTIVE OVERJACKET

BACKGROUND OF THE INVENTION

Firefighters wear protective coats and trousers to shield their bodies from heat, flame, liquid penetration, and from other hazardous conditions that a firefighter may encounter while fighting a fire. These protective garments are typically made in layers beginning at the interior with a thermal inner liner provided to insulate the firefighter's body from heat penetration; next a moisture barrier provided to repel liquids, particularly water used to extinguish or suppress the fire, and for preventing such liquids from reaching the firefighter's body; and next an outer protective shell provided to act as a primary shield against flame, heat, debris and other hazardous exposures present at a fire.

The outer protective shell also acts as the functional outer surface of the garment. It provides a surface for reflective trim for visibility and for the attachment of pockets, hooks, straps, etc. for carrying the equipment needed to perform firefighting duties. Consequently, the outer protective shell is both the sacrificial outer layer of protection and the most complex and expensive element of the firefighter's multilayered garment.

In recent years, and largely because of the rapid improvement in protection offered by better materials and designs, the amount of flame and extreme heat exposure typically experienced by a firefighter has increased. In specific cases, tactics have been modified to approach a fire very rapidly and aggressively. These tactics greatly increase the exposure of the outer shell to heat and direct flame. Two factors are immediately impacted. First the outer shell typically is at least partially consumed by flame and heat significantly faster, and is consequently damaged with higher frequency and cost. Second, the greatly increased heat penetrates significantly more rapidly to the interior, which if not compensated for can cause extreme discomfort or burn injury to the firefighter.

The historic and current response to these two key factors has been to provide outer protective shell materials that can take more and longer flame exposure, and to provide extra thermal protection either under the outer protective shell and the inner thermal lining component, or both.

Outer protective shell fabrics have been improved, increasing resistance to flame from instant deterioration to limited delayed deterioration, prolonging disposal of the outer shell substantially. But, insofar as is presently known, no fabric has yet been introduced for standard issue which could sustain direct flame contact indefinitely, without deterioration. And when deterioration finally reaches a point where repair or replacement of the outer protective shell becomes necessary, the most complex and expensive component—the outer protective shell—must be retired from service.

It is important to note that the highest level of exposure on the firefighter's protective garment occurs where the heat is concentrated. In a burning structure, heat rises and concentrates in strata in the structure, very predictably. If the temperature at the ceiling of a fire-involved structure has reached 800°-1000° F. (typical in a residential or commercial structure), then the heat will have stratified at about 650° F. at standing head height (top of doorway), and will drop to 250° at 44" (kneeling head height). Floor temperatures will typically remain at 150° F.

When an aggressive fire attack is made, firefighters will move upright, but crouched, through the hotter strata, exposing their heads and upper torsos to the higher heat and the more frequent flame exposures that exist at this level. Consequently, there is typically a need to focus the extra flame and thermal protection in the upper portion of the outer protective shell.

Accordingly, there exists a need in the firefighter's multilayer protective garment art for an additional garment that can be worn over the outer protective shell needing additional flame and thermal protection and which garment can be removed when such additional flame and thermal protection is not needed.

More particularly, this invention is an improvement to the invention of U.S. Pat. No. 4,507,806 entitled Protective Garment, patented Apr. 2, 1985, Christopher E. Coombs inventor, assigned to Cairns & Brother Inc., the assignee of the present invention; this patent is hereby incorporated herein by reference as if fully reproduced herein and is hereinafter referred to as the "'806 patent."

The protective garment of the '806 patent includes a protective outer shell 12 and an inner thermal liner 34 worn under the outer protective shell. As described in the '806 patent and shown in FIG. 1 of its drawings, the outer protective shell 12 includes a neck opening 24 surrounded by a collar or annular tab 22 provided on its outer surface 26 with a VELCRO ® fastening material strip 28 and provided on its inner surface 30 with a VELCRO ® fastening material strip 32. The inner thermal liner 34, FIG. 2 of the '806 patent, includes a neck opening **24*a* surrounded by a collar 44 provided with a circumferential outer flap 46 extending downwardly from the Circumference of an upper collar edge 48; the outer and inner surface of the collar 44 is provided with a VELCRO ® fastening material strip 54 and the inner surface of the outer flap 46 is provided with a strip 52. These VELCRO ® fastening material strips, as taught in the '806 patent and as illustrated in FIG. 3 of the '806 patent, provide interconnecting means for interconnecting the collars of the outer protective shell 12 and the inner thermal lining 34 which both interconnects such collars and provides a visual indication that the thermal inner liner has been assembled to the outer shell and is being worn by the wearer, e.g. firefighter, of the outer shell and inner liner. This visual indication, as taught in the '806 patent, is provided by the outer collar flap 46 of the inner thermal liner 34 which obscures from view the collar or annular tab 22 of the outer shell 12 which collar 22 is made, for example, and as taught in the '806 patent, of a bright fluorescent material contrasting with the remainder of the outer shell and which bright material is obscured from view upon the flap 46 of the inner liner collar 44 being fastened over the collar or annular tab 22 of the outer protective shell 12. Generally, and as taught in the '806 patent, the protective outer shell 12 is designed primarily to shed water and the inner thermal liner 34 is designed primarily to provide the wearer, e.g. firefighter, with thermal insulation. The inner thermal liner 34 may include a moisture barrier layer, such as moisture barrier 42 shown in FIG. 2** of the '806 patent.

SUMMARY OF THE INVENTION

It is the primary object of the present invention to satisfy the foregoing need in the art and to provide the improvement in the invention of the '806 patent.

A garment satisfying such needs may include a thermal protective overjacket for being worn over the outer protective shell and inner thermal liner of a person such as a firefighter, and for providing additional flame and thermal protection to the upper torso of the firefighter particularly the upper chest, upper back, and upper arms of the firefighter's body. In one embodiment fasteners are provided for interconnecting the collars of the protective thermal overjacket, the inner thermal liner and the outer protective shell; however, in an alternate embodiment, the collar of the thermal protective overjacket of the present invention is provided with a collar having fastening means for fastening the collar of the overjacket around the collar of the outer protective shell.

DESCRIPTION OF THE PREFERRED EMBODIMENT

For convenience of reference, the structural elements of the protective garment of the '806 patent shown in the above-described drawings are given the same numerical references as in the '806 patent.

Figure 1:
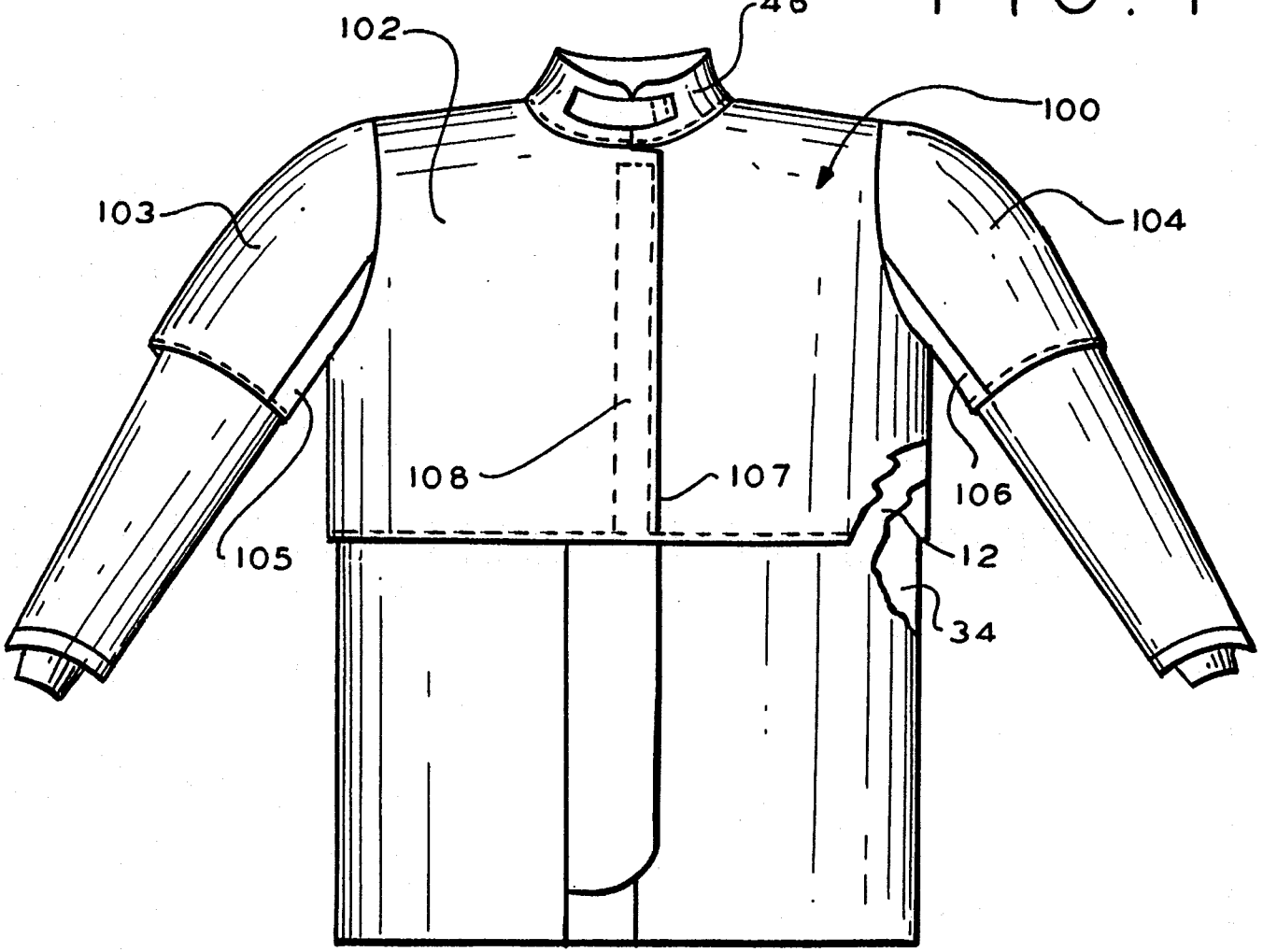
FIG. 1 is a front elevational assembly view showing one embodiment of the thermal protective overjacket of the present invention residing over an outer protective garment such as for example the outer protective shell 12 of the '806 patent which outer protective shell 12 is shown residing over, for example, the inner protective lining 34 of the '806 patent.

Referring now to FIG. 1, the first embodiment of the thermal protective overjacket of the present invention is indicated by general numerical designation 100 and includes a body 102, sleeves 103 and 104 and undersleeves 105 and 106. The thermal protective overjacket 100 is shown immediately overlying an outer protective garment such as, for example, the outer protective shell 12 of the '806 patent which outer protective shell 12 is shown immediately overlying, for example, the inner thermal lining 34 of the '806 patent. The body 102 of the thermal protective overjacket 100 is openable and closable in the front, and such opening and closing is provided by an overlying portion 107 shown in solid outline and an underlying portion 108 shown in dashed outline. These overlying and underlying portions 107 and 108 may be provided with suitable fastening means for opening and closing the body 102 of the thermal protective overjacket 100 which fastening means may be, for example, opposed vertically extending strips of VELCRO ® fastening material.

Figure 2:
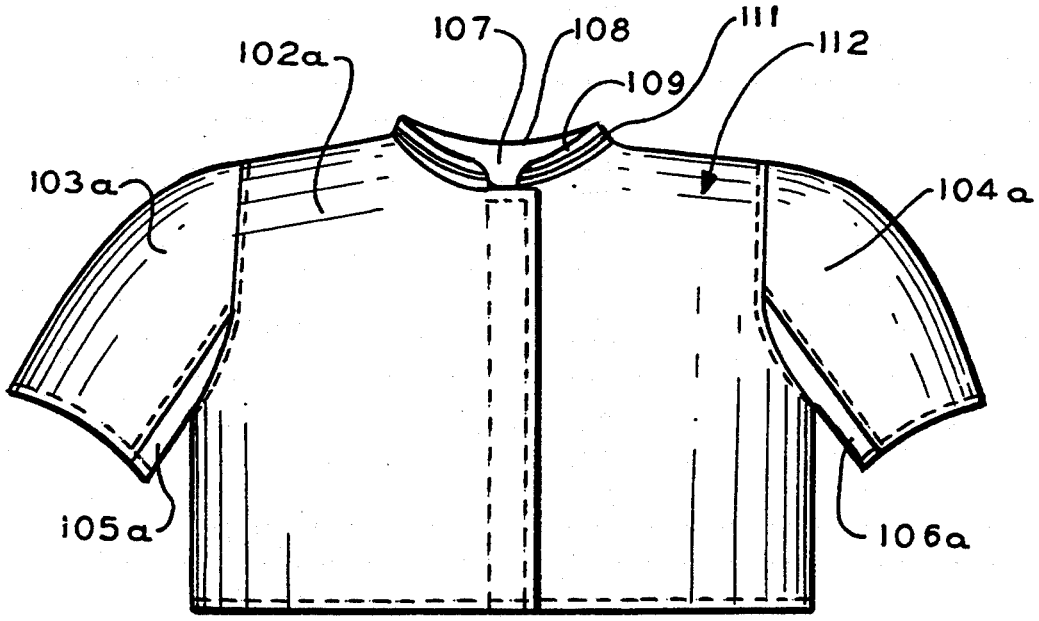
FIGS. 2 and 3 are, respectively, front and rear views of one embodiment of the outer protective shell of the thermal protective overjacket of the present invention.
Figure 3:
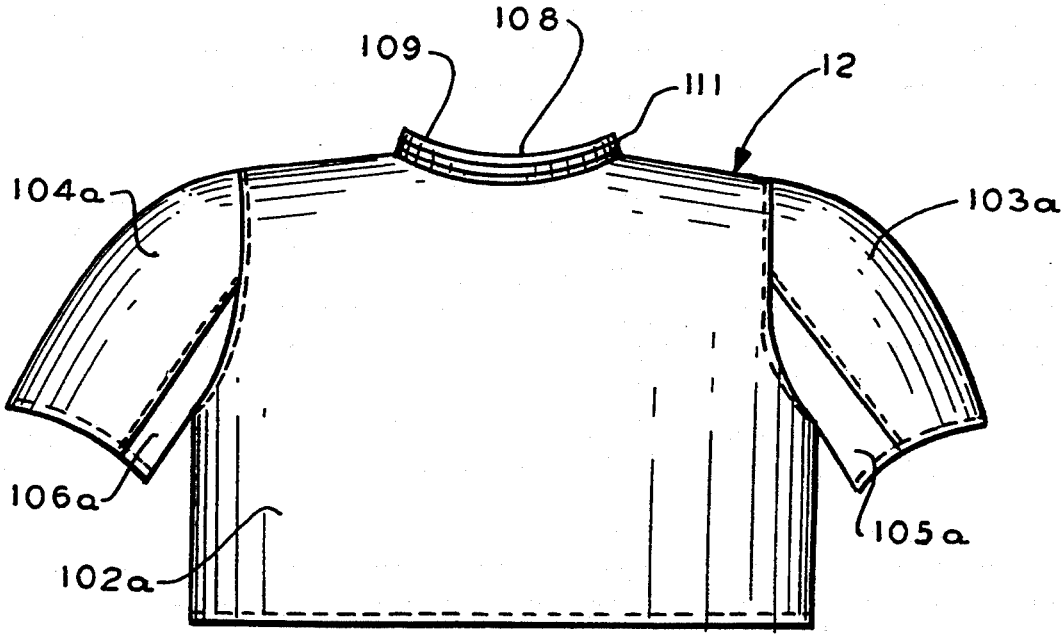
Figure 4:
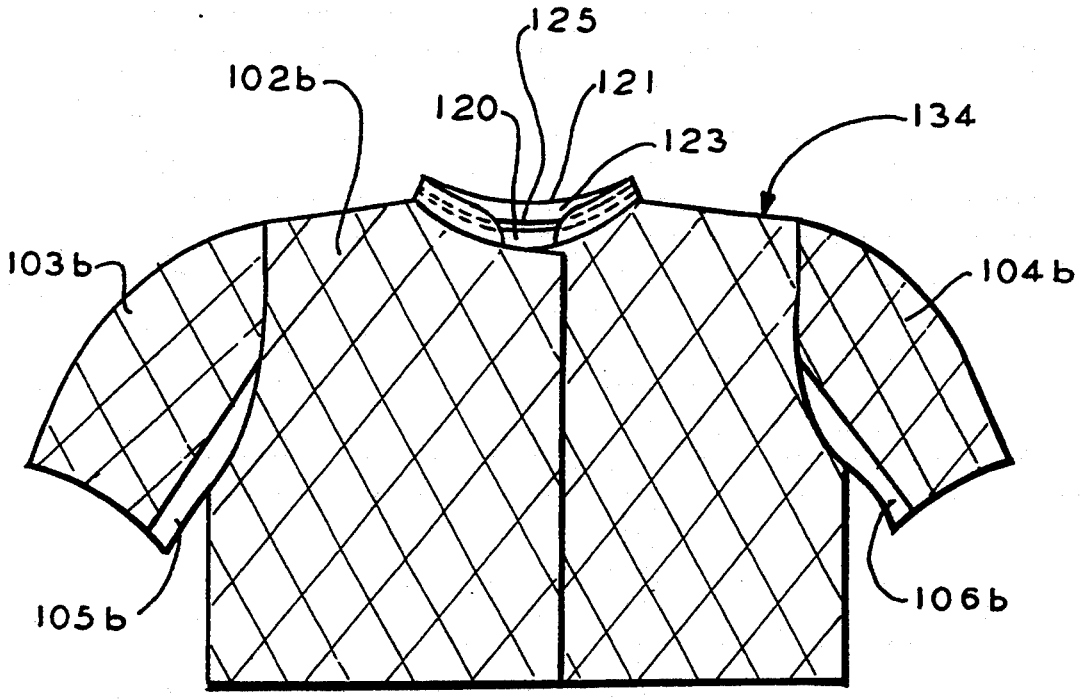
FIGS. 4 and 5 are, respectively, front and rear views of one embodiment of the inner thermal liner of the thermal protective overjacket of the present invention.
Figure 5:
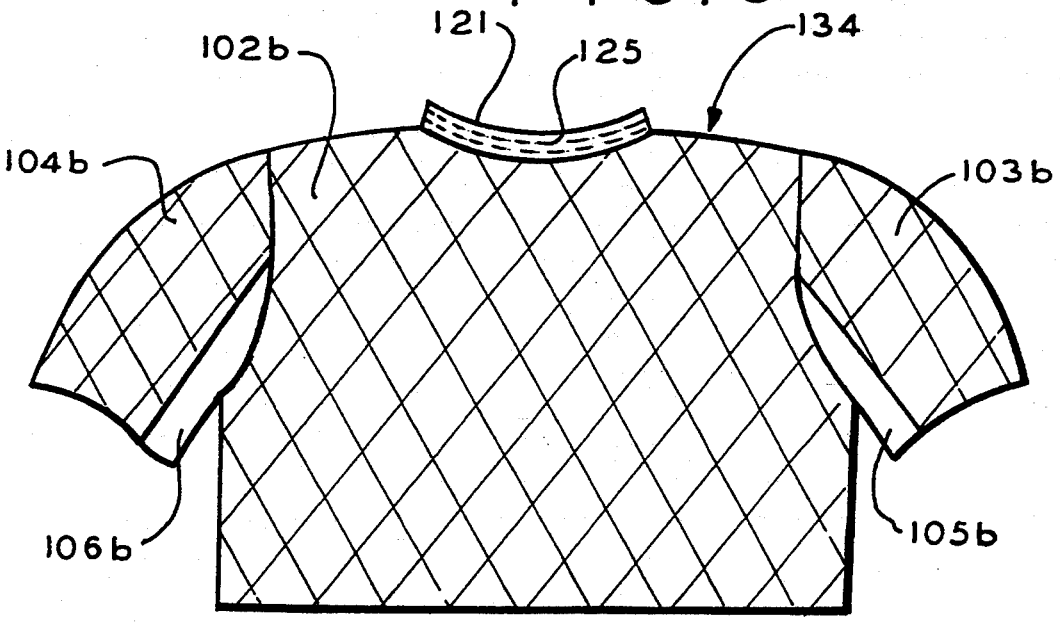

The thermal protective overjacket 100 may include an outer protective shell indicated by general numerical designation 112 in FIGS. 2 and 3 and an inner thermal liner indicated by general numerical designation 134 in FIGS. 4 and 5. The outer protective shell 112, FIGS. 2 and 3, may include a body **102*a*, sleeves 103*a* and 104*a* and undersleeves 105*a* and 106*a*. The body 102*a* is provided with a neck opening 107 surrounded by an upwardly extending annular tab or collar 108 including an outer surface 109 provided with a strip of VELCRO ® fastening material 111. The outer protective shell 112** of the overjacket may be made of suitable outer protective shell material for protecting the wearer against heat and flame present at a fire, such as for example, a fabric woven from NOMEX ® fibers available from E.I. DuPont deNemours Company, a fabric woven from a combination of PBI TM fibers available from Celanese Corp., and KELVAR ® fibers ® available from E.I. DuPont deNemours Company, and the like.

The inner thermal liner 134, FIGS. 4 and 5, includes a body **102*b*, sleeves 103*b* and 104*b* and gussets 105*b* and 106*b*. The body 102*b* of the inner thermal liner 134 is provided with a neck opening 120 surrounded by an upwardly extending annular tab or collar 121 including an inner surface 123 provided with a VELCRO ® fastening material strip 125. The thermal liner 134 of the overjacket may be made of suitable material for protecting the wearer against heat present at a fire, such as for example, quilted material consisting of a suitable face cloth and suitable batting material, one-piece needlepunch or stitchbonded fabric constructed from aramid fibers such as KELVAR ® or NOMEX ® fibers available from E.I. DuPont deNemours Company. Further, the inner thermal liner 134** may comprise a single or multiple layers of insulating material, and the like.

In the manner known to the garment art, the outer protective shell 112 of FIGS. 2 and 3 and the inner thermal liner 134 of FIGS. 4 and 5 may be suitably joined together at all edges, hems, necklines, closures, etc., to provide a unitary garment. Upon the annular tab or collar 108 of the outer thermal shell 112 being joined to the annular tab or collar 121 of the inner thermal liner 134 such annular tabs or collars cooperatively form a thermal protective overjacket annular tab or collar indicated by reference numeral 135 in FIG. 6. Alternatively, the lower hem lines of the outer protective shell 112 and the inner thermal liner 134 may not be joined and may remain open to provide space into which air may upwardly billow to provide further thermal insulation to the wearer of the thermal protective overjacket 100.

Figure 6:
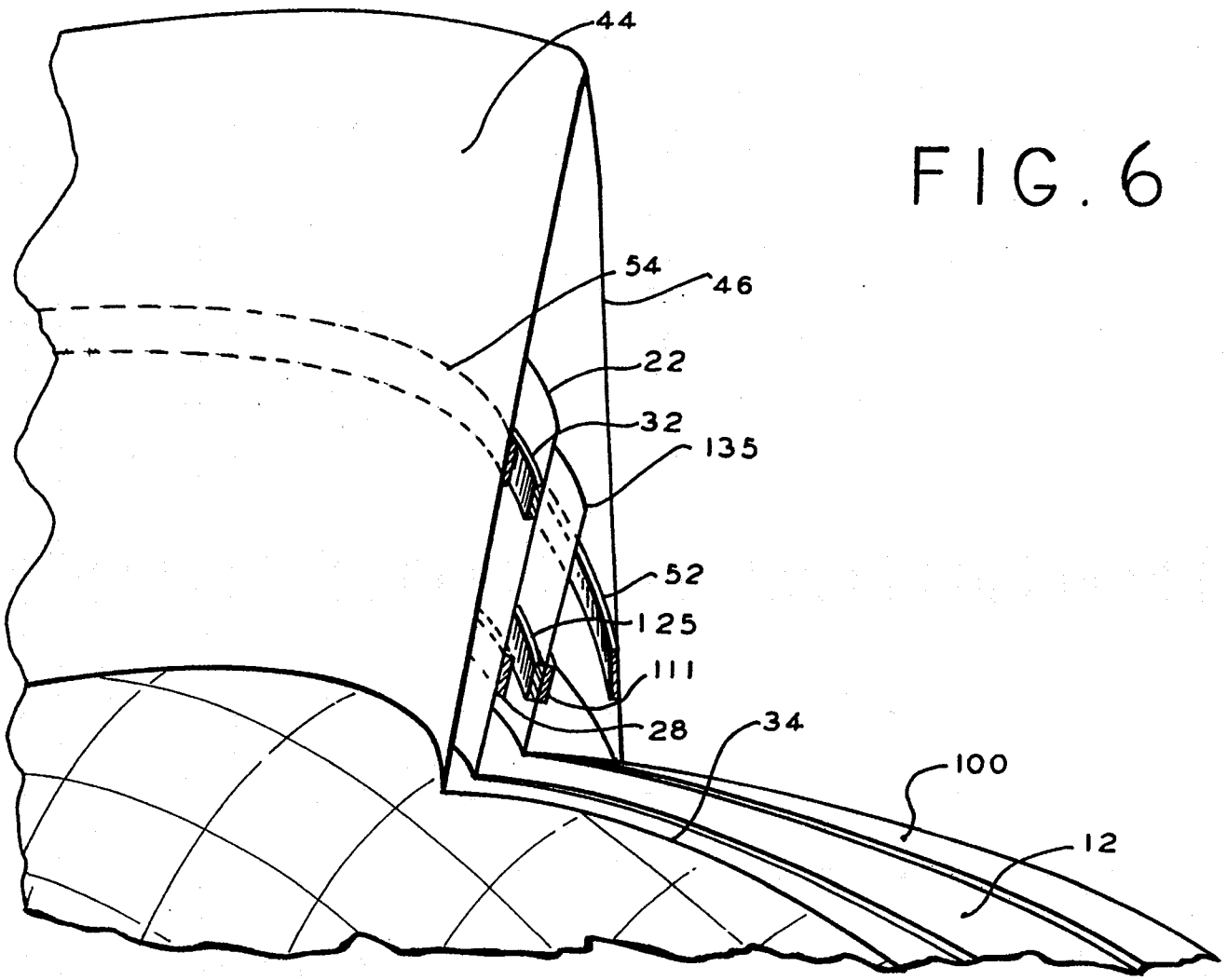
FIG. 6 is a diagrammatical illustration illustrating the manner in which the collar of one embodiment of the thermal protective overjacket of the present invention, the collar and outer flap of the inner thermal lining and the collar of the outer protective shell are interconnected.

Referring now to FIG. 6, the interconnecting of the annular tab or collar 135 of the thermal protective overjacket 100, the annular tab or collar 22 of the outer shell 12, and the collar 44 and outer circumferential flap of the inner thermal liner 34 will now be described. The annular tab or collar 22 of the outer protective shell 12 is inserted intermediate the collar 44 and outer circumferential flap 46 of the inner thermal liner 34 and resides immediately adjacent the outer surface of the collar 44 of the inner thermal liner 34. The annular tab or collar 135 of the thermal protective overjacket 100 is inserted intermediate the annular tab or collar 22 of the outer protective shell 12 and the outer circumferential flap 46 of the inner thermal liner 34 and resides adjacent the outer surface of the collar 22 of the outer protective shell 12 and the inner surface of the outer circumferential flap 46 of the collar 44 of the inner thermal liner 34.

The VELCRO® fastening material strip 54 provided on the outer surface of the collar 44 of the inner thermal liner 34 is interconnected with the VELCRO® fastening material strip 32 provided on the inner surface of the annular tab or collar 22 of the outer protective shell 12. The VELCRO® fastening material strip 28 provided on the outer surface of the collar 22 of the outer protective shell 12 is connected with the VELCRO® fastening material strip 125 provided on the inner surface of the collar 135 of the thermal protective overjacket 100. The VELCRO® fastening material strip 111 provided on the outer surface of the collar 135 of the thermal protective overjacket 100 is interconnected with the VELCRO® fastening material strip 52 provided on the inner surface of the circumferential flap 46 of the collar 44 of the inner thermal liner 34.

In the preferred embodiment, and referring again to FIG. 6, it will be noted that the VELCRO® fastening material strip 54 provided on the outer surface of the collar 44 of the inner thermal liner 34 is provided at a first level and that the VELCRO® fastening material strip 52 provided on the inner surface of the circumferential flap 46 is provided at a second level lower than the first level. It will be noted that the VELCRO® fastening material strip 32 provided on the inner surface of the collar 22 of the outer protective shell 12 is provided at the first level, and that the VELCRO® fastening material strip 28 provided on the outer surface of the collar 22 of the outer protective shell 12 is provided at the second level. It will be further noted that the VELCRO® fastening material strips 125 and 111 provided respectively on the inner and outer surfaces of the collar 134 of the thermal protective overjacket 100 are provided at the second level.

Figure 7:
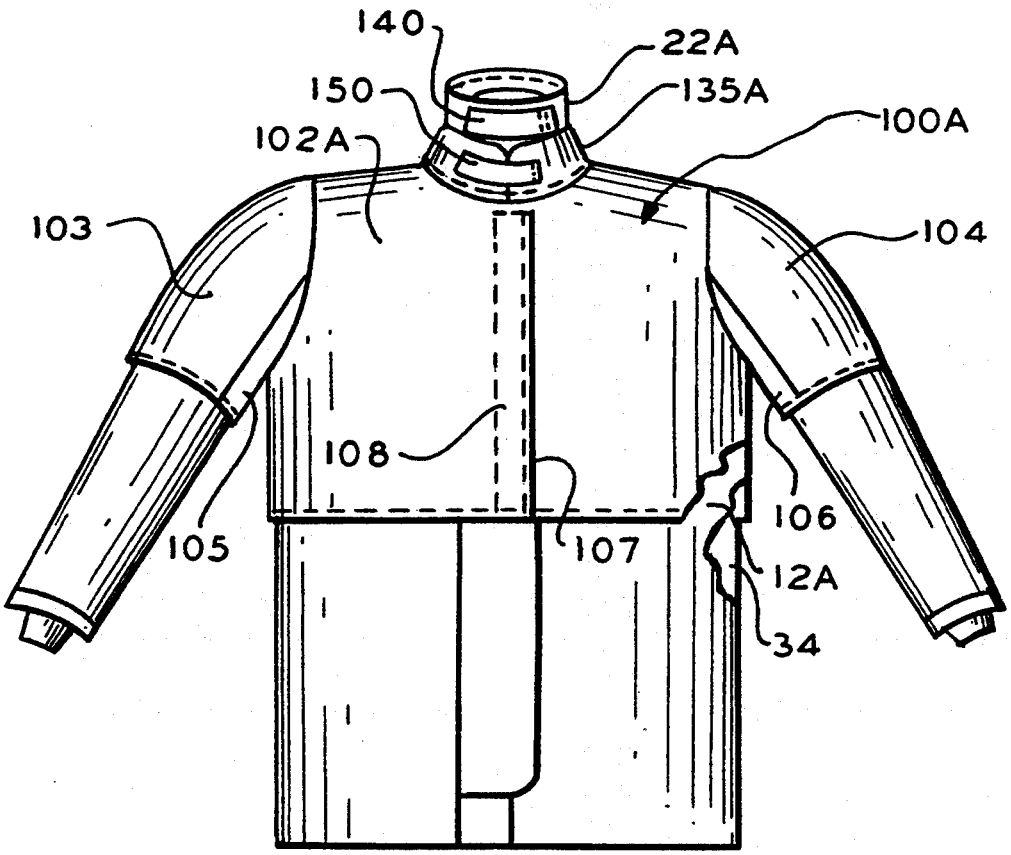
FIG. 7 is a front elevational assembly view of an alternate embodiment of the thermal protective overjacket of the present invention provided with a collar having fastening means for fastening the collar of the overjacket around the collar of an outer protective garment such as the outer protective shell 12 shown in FIG. 1 of the '806 patent.

An alternate embodiment of the thermal protective overjacket of the present invention is shown in FIG. 7 and indicated by general numerical designation 100A. Thermal protective overjacket 100A includes the same elements as thermal protective overjacket 100 described above and shown in FIGS. 1–6 except for the collar 135A which, in this embodiment, and as will be generally understood, is fastened around the collar 22A of an underlying outer protective garment such as, for example, an outer protective shell 12A which is a modification of the outer protective shell 12 disclosed in the '806 patent. The modified outer protective shell 12A includes the same elements as the outer protective shell 12 disclosed in the '806 patent except for the collar 22A. It will be generally understood from FIG. 7 that the collar 22A of the outer protective shell 12A is provided with a tab 140 for fastening the collar closed and that the thermal protective overjacket 100A is provided with a tab 150 for closing the collar 135A of the overjacket 100A around the collar 22A of the outer protective shell 12A.

Figure 8:
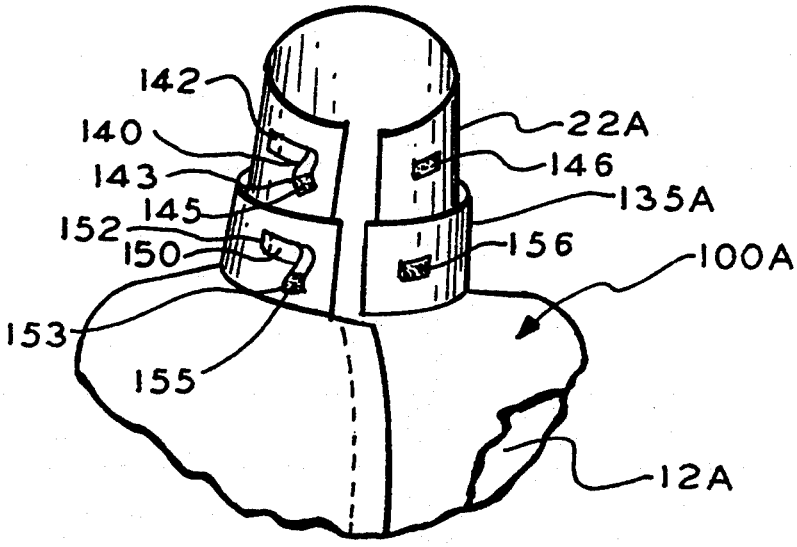
FIG. 8 is a partial view of FIG. 7 but with the collar shown open.

Referring now to FIG. 8, it will be understood that in this embodiment, the collar 22A of the outer protective shell 12A is provided with the tab 140 as noted above, and the end 142 of the tab is suitably secured to the outer surface or outer portion of the collar 22A such as by suitable stitching and the other end of the tab 140 is provided on its inner surface with a VELCRO® fastening material strip or patch 143. The collar 22A of the outer protective shell 12A is also provided with a VELCRO® fastening material strip or patch 146 which may be engaged by the VELCRO® fastening material patch 143 to fasten the collar 22A closed as shown in FIG. 7.

Similarly, the thermal protective overjacket 100A is provided with the tab 150 as noted above, and the end 152 of the tab is suitably secured to the outer surface or outer portion of the collar 135A such as by suitable stitching, and the other end of the tab 150 is provided on its inner surface with a VELCRO® fastening material strip or patch 153. The collar 135A of the thermal protective jacket 100A is also provided with a VELCRO® fastening material strip or patch 156 which may be engaged by the Velcro® patch 153 to fasten the collar 135A closed around the collar 22A as shown in FIG. 7.

Referring again generally to the embodiments of the thermal protective overjacket of the present invention and referring again generally to FIGS. 1 and 7, it will be noted that the thermal protective overjacket embodiments 100 and 100A are for being worn over an outer protective garment, such as for example the outer protective shell 12 of the '806 patent, for providing additional flame and thermal protection to the upper torso of a person such as a firefighter, particularly the firefighter's upper chest, upper back and upper arms, and it will be particularly noted that the thermal protective overjacket embodiments 100 and 100A are provided with sleeves 103 and 104 shorter in length than the sleeves of the underlying outer protective garment, includes body portions 102 and 102A shorter in length than the underlying body portions of the outer protective garment, and that the thermal protective overjacket 100A shown in FIG. 7 is provided with a collar 135A shorter in height than the collar 22A of the underlying outer protective garment such as the underlying outer protective shell 12A.

It will be understood that the embodiments of the thermal protective overjacket of the present invention provide the following contributions to the art:

1. The firefighter is provided with a means of increasing his thermal protection that can be "adjusted" by altering either the thickness or coverage of the thermal protective overjacket.
2. The firefighter is provided with a garment, i.e. thermal protective overjacket, that interfaces with his current protective garment, due to the fact that the thermal protective overjacket is designed to be worn over the existing protection garment.
3. The firefighter can doff (remove) the thermal protective overjacket when conditions of less heat and longer duration are present, such as highrise logistical tasks, vehicle fires, outside fires (brush, etc.).
4. The firefighter's extra protection provided by the thermal protective overjacket increases body heat release through bellowing and evaporative cooling when compared to permanently configured alternatives.
5. The thermal protective overjacket in the first embodiment is integrated completely into the releasable collar and sleeves disclosed in the '806 patent, preventing any intrusion of unwanted debris, etc.

6. The thermal protective overjacket is easily removed and installed making maintenance easy and inexpensive.
7. The thermal protective overjacket is economical compared to the typical complete outer protective shell. This is important because the thermal protective overjacket is exposed to the worst hazardous conditions and will sustain damage. This is its intended purpose. When damage occurs, the only garment that needs to be replaced or repaired is the thermal protective overjacket itself.
8. The integration of the thermal protective overjacket in the first embodiment complements the protective garments already in use which employ the releasable collar device of the '806 patent; these systems are designed to work with each other.
9. Economy is served because the thermal protective overjacket employs only the fabrics needed to accomplish the intended protection, and is not encumbered by the more expensive closures, pockets, trim and attachments typically associated with a typical outer garment.
10. The adaptability of the thermal protective overjacket will improve firefighter safety and health by providing a light weight, comfortable, stress reducing and removable alternative to a heavy, protective coat and provides protection commensurate with the expected thermal exposure, instead of one, extreme level of protection which may be needed only part of the time.

Although not shown in the drawings, it will be understood that in the event the thermal protective overjacket 100 obscures reflective trim for visibility, pockets, hooks, straps, etc. present on the portion of the outer protective shell 12 covered by the thermal protective overjacket, the thermal protective overjacket 100 may be provided with such trim, pockets, hooks, straps, etc.

It will be understood that many variations and modifications may be made in the present invention without departing from the spirit and the scope thereof.

What is claimed:

1. Combination garments for being worn by a person for protection against hazardous conditions, comprising:

an outer protective shell provided with a collar including an inner surface and an outer surface, first fastening means provided on the inner surface of the outer protective shell collar and second fastening means provided on the outer surface of the outer protective shell collar;

an inner thermal liner for being worn under the outer protective shell, said inner thermal liner provided with a collar including an outer surface and an outer downwardly extending circumferential flap provided with an inner surface, third fastening means provided on the outer surface of the inner thermal liner collar and fourth fastening means provided on the inner surface of the flap;

a thermal protective overjacket for being worn over the outer protective shell to provide the person with additional protection and thermal insulation against the hazardous conditions, said thermal overjacket provided with a collar including an inner surface and an outer surface, fifth fastening means provided on the inner surface of the collar of the thermal protective overjacket and sixth fastening means provided on the outer surface of the collar of the thermal protective overjacket;

the collar of the outer protective shell for residing intermediate the collar and flap of the inner thermal liner and adjacent the inner surface of the collar of the inner thermal liner;

the collar of the thermal protective overjacket for residing intermediate the collar of the outer protective shell and the flap of the collar of the inner thermal liner and adjacent the outer surface of the collar of the outer protective shell and the inner surface of the flap of the collar of the inner thermal liner; and the first and third fastening means for being fastened together, the second and fifth fastening means for being fastened together, and the fourth and sixth fastening means for being fastened together to fasten said collars together.

* * * * *